United States Patent [19]

Jennings

[11] Patent Number: 4,479,688

[45] Date of Patent: Oct. 30, 1984

[54] WALL OUTLET LOCK APPARATUS

[76] Inventor: Gordon B. Jennings, 2562 E. Glade, Mesa, Ariz. 85204

[21] Appl. No.: 334,148

[22] Filed: Dec. 24, 1981

[51] Int. Cl.[3] ..... H01R 13/502; H01R 13/44

[52] U.S. Cl. ..... 339/37; 200/42 R; 200/44; 339/82

[58] Field of Search ..... 339/37, 82; 200/50 B, 200/42, 44

[56] References Cited

U.S. PATENT DOCUMENTS

| | | | |
|---|---|---|---|
| 3,524,029 | 8/1970 | Laff | 200/44 |
| 4,063,110 | 12/1977 | Glick | 200/44 |
| 4,080,029 | 3/1978 | St. Fort | 339/82 |
| 4,166,202 | 8/1979 | Reiter | 200/44 |

*Primary Examiner*—Joseph H. McGlynn
*Assistant Examiner*—Paula Austin
*Attorney, Agent, or Firm*—Weiss & Holloway

[57] ABSTRACT

A wall outlet lock apparatus for retaining an electrical appliance plug at an electrical wall outlet comprises an electrical plug receptacle for receiving an electrical appliance plug; a power transfer unit coupled to the electrical plug receptacle for transferring power from the electrical wall outlet to the electrical plug receptacle; a first locking mechanism for restricting removal of the wall outlet lock apparatus from the electrical wall outlet; and a second locking mechanism coupled to the power transfer unit for disengaging the power transfer unit from the electrical plug receptacle to prohibit transfer of power from the electrical wall outlet to the electrical plug receptacle.

9 Claims, 4 Drawing Figures

WALL OUTLET LOCK APPARATUS

BACKGROUND OF THE INVENTION

1. Field of the Invention

This invention relates generally to a wall outlet lock apparatus and, more specifically, to an apparatus which electrically couples to an electrical wall outlet and includes first means for securely and safely locking electrical appliance plugs into plug receptacles and second means for prohibiting power from reaching the plug receptacles and hence preventing the appliance from being used.

2. Description of the Prior Art

In the past, there has been disclosed a number of inventions which attempt to secure electrical appliance plugs in electrical wall outlets.

U.S. Pat. No. 3,159,446 to Protzmann discloses a pilfer-proof wall plate. The wall plate replaces any common duplex receptacle coverplate, and prevents an appliance plug from being removed by incorporating a screw with a non-back out head. However, access to the plug, when desired, is extremely difficult. In addition, there is provided no means for preventing current from reaching the appliance.

U.S. Pat. No. 3,067,402 to Thaw discloses a safety shield and electrical plug lock for securing a male plug to a female wall outlet. A plug cap is secured to the shield by screws and thus prevents the plug from being pulled out of the socket. However, the screws are easily removed permitting theft of the appliance. In addition, there is provided no means for preventing the appliance from being used, as power cannot be prevented from reaching the appliance.

Various other inventions have been disclosed with their objective being to prevent easy removal of plugs from wall sockets. In addition, numerous inventions have been disclosed which prevents access to the wall sockets so as to prevent injuries to unwary parties. See U.S. Pat. No. 2,987,690 to Marbars and U.S. Pat. No. 2,891,102 to Gumes for examples.

There existed a need to provide an improved wall outlet lock apparatus which would not only prevent undesired removal of appliance plugs from wall sockets but would also provide a means for preventing power from reaching the appliance to prohibit use of the appliance.

SUMMARY OF THE INVENTION

It is an object of this invention to provide an improved wall outlet lock apparatus.

It is a further object of the invention to provide an improved wall outlet lock apparatus which prohibits undesired removal of appliances by preventing the appliance plug from being removed from the apparatus.

It is yet another object of the invention to provide an improved wall outlet lock apparatus which includes means for preventing the undesired removal of the apparatus from an electrical wall outlet.

It is a still further object of the present invention to provide an improved wall outlet lock apparatus which prevents the undesired use of an appliance by prohibiting power from reaching the appliance.

Yet another object of the present invention is to provide an improved wall outlet lock apparatus which permits easy removal of the appliance plug from the apparatus by an authorized individual.

The above and other objects are achieved by a wall outlet lock apparatus for retaining an electrical appliance plug at an electrical wall outlet comprising an electrical plug receptacle for receiving an electrical appliance plug; power transfer means coupled to the electrical plug receptacle for transferring power from the electrical wall outlet to the electrical plug receptacle; first locking means for restricting removal of the wall outlet lock apparatus from the electrical wall outlet; and second locking means coupled to the power transfer means for disengaging the power transfer means from the electrical plug receptacle to prohibit transfer of power from the electrical wall outlet to the electrical plug receptacle.

The foregoing and other objects, features and advantages of this invention will be apparent from the following more particular description of the preferred embodiments of the invention as illustrated in the accompanying drawings.

THE SPECIFICATION

Figure 1:
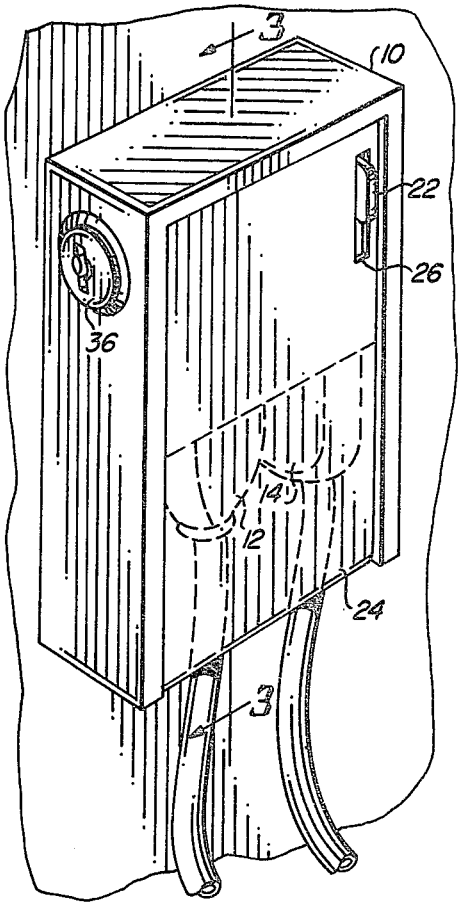
FIG. 1 is a front perspective view of the inventive wall outlet lock apparatus of the present invention engaged by a plurality of electrical appliance plugs.
Figure 2:
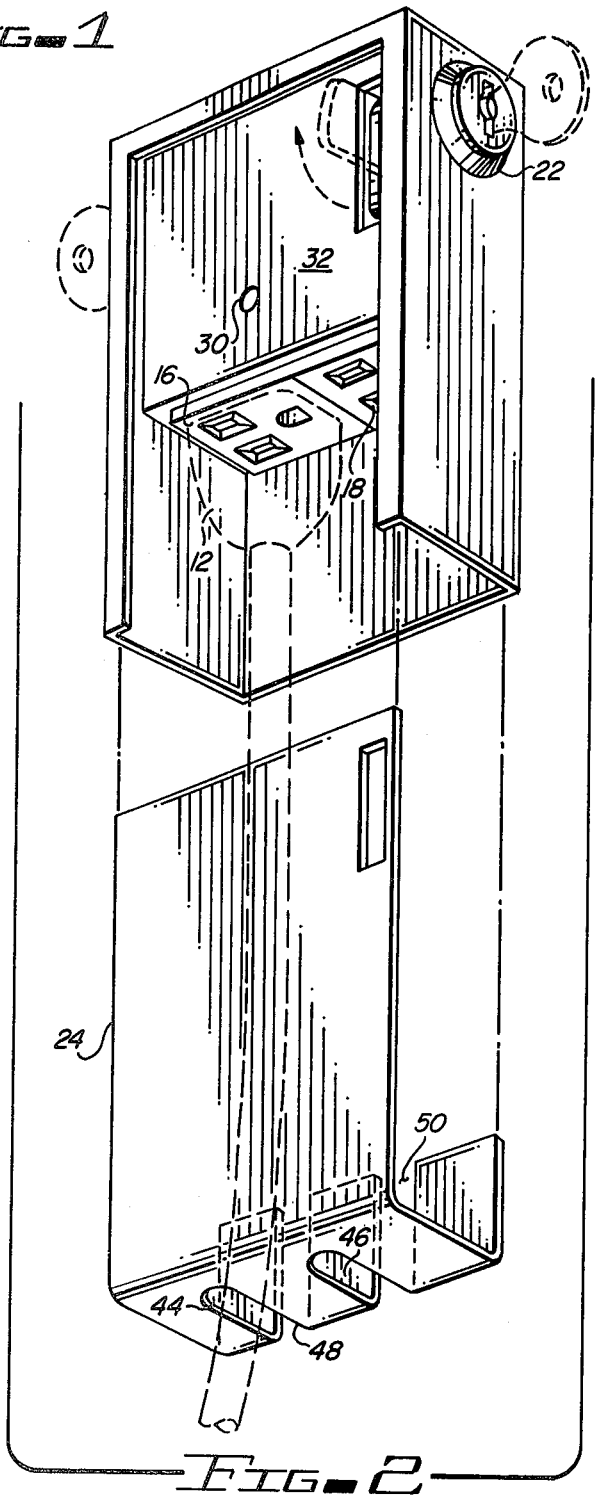
FIG. 2 is a rear perspective view of the inventive wall outlet lock apparatus of the present invention of FIG. 1 with a first key lock means disengaged from a partially removed cover means.
Figure 3:
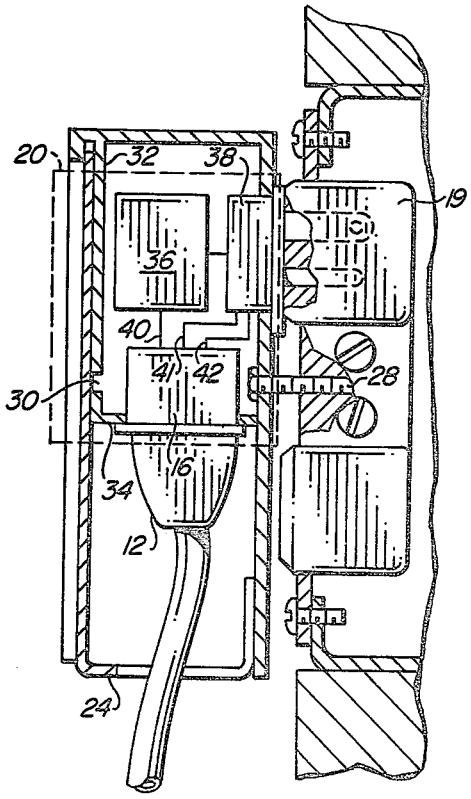
FIG. 3 is a cross-sectional view of the inventive wall outlet lock apparatus of the present invention taken along line 3—3 of FIG. 1.

Referring to FIGS. 1, 2 and 3, a wall outlet lock apparatus 10 is shown retaining a plurality of electrical appliance plugs 12 and 14. The appliance plugs 12 and 14 are received at electrical plug receptacles 16 and 18. Power is transferred to the electrical plug receptacles 16 and 18 from an existing wall outlet 19 by power transfer unit referenced generally by the numeral 20 (see FIG. 3). A first key lock mechanism 22 engages a removable cover 24 at a slot 26. The removable cover means 24, when engaged by the first key lock mechanism 22, covers and restricts access to a setting screw 28 (see FIG. 3). Access to setting screw 28 is through access hole 30 in a rear plate 32 of an electrical plug receptacle housing 34. A second key lock mechanism 36 is electrically coupled to the electrical plug receptacles 16 and 18, and to power transfer unit 20. The second key lock mechanism 36 operates as a locking electrical switch which, when unlocked, allows power to be transferred to the electrical plug receptacles 16 and 18, and when locked, prohibits power from being transferred. Thus, second key lock mechanism restricts the flow of power from the electrical wall outlet 19 and the electrical plug receptacles 16 and 18.

Referring to FIG. 2, the first key lock mechanism 22 is disengaged from the removable cover 24. Thus, the removable cover 24 can be removed to allow access to the setting screw 28 through access hole 30. In addition, with the removable cover 24 partially removed, appliance plugs 12 and 14 can be removed from the electrical plug receptacles 16 and 18, respectively.

Referring to FIG. 3, power transfer unit 20 comprises a first electrical plug 38 which is fixedly coupled to the apparatus 10. The first electrical plug 38 electrically engages the existing wall outlet 19, and is correspondingly electrically coupled to the electrical plug receptacles 16 and 18 (only one shown in FIG. 3) by wires 40, 41 and 42. Wire 40, however, is interrupted by the second key lock mechanism 36 so as to permit control of the transfer of power from the wall outlet 19 to the electrical plug receptacles 16 and 18 as described above. Setting screw 28 is shown coupled to the existing wall outlet 19 so as to assure that the first electrical plug 38 remains electrically engaged to the existing wall outlet 19. Also, setting screw 28 further prevents the wall outlet lock apparatus 10 from being removed from the wall outlet 19 unless the first key lock mechanism 22 is disengaged to allow removal of the cover 24 and access to the setting screw 28.

Figure 4:
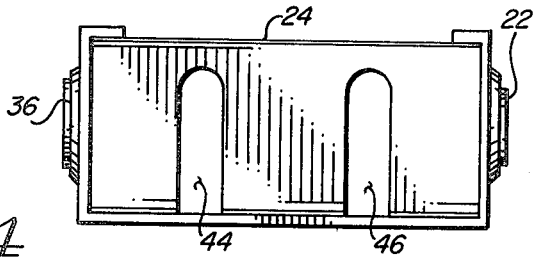
FIG. 4 is a bottom view of the inventive wall outlet lock apparatus of FIG. 1.

Referring to FIGS. 2 and 4, the removable cover 24 includes a plurality of appliance plug access openings 44 and 46. When the cover 24 is engaged by the first key lock mechanism 22, the openings 44 and 46 prevent appliance plugs from being removed. When the cover 24 is disengaged from the first key lock mechanism 22 and removed from the apparatus 10, appliance plugs can be easily removed through vertical portions 48 and 50 of plug access openings 44 and 46, respectively (see FIG. 4).

Thus, the wall outlet lock apparatus combines prohibiting removal of appliance plugs with prohibiting transfer of power to an appliance unless respective key locks are disengaged.

While the invention has been particularly described and shown in reference to the preferred embodiments thereof, it will be understood by those skilled in the art that various changes in form and detail may be made therein without departing from the spirit and scope of the invention which is limited only by the appended claims.

What is claimed is:

1. An electrical wall outlet plug lock apparatus for locking an electrical appliance plug at an electrical wall outlet comprising:

a housing enclosure means including a base means and selectively removable security cover means;

at least one electrical plug recepticle operatively coupled within said housing enclosure means for removably receiving at least one electrical appliance plug therein for completing an electrical circuit conection therebetween;

a master electrical plug operably disposed within said base means including plug prongs operably disposed through the bottom of said base means of said housing enclosure means for mechanically and electrically engaging said wall outlet;

fastening means operably disposed within said base means for operatively securing said base means of said housing enclosure means to a selected wall location proximate said wall outlet such that the plug prongs of said master electrical plug are continuously mechanically and electrically coupled within said wall outlet for maintaining a continuous supply of electrical power therebetween until the housing enclosure means is removed from the wall;

power transfer means operably disposed within said housing enclosure means and electrically coupled between said at least one electrical plug receptacle and said master electrical plug for transfering electrical power from said master electrical plug to said at least one electrical plug receptacle;

said housing enclosure means further including means for operatively covering said base means with said selectively removable security cover means for preventing said at least one electrical plug from being removed from said housing enclosure means and for concealably protecting said fastening means from being unfastened for preventing the removal of said housing enclosure means from said selected wall location and preventing the mechanical and electrical uncoupling of said plug prongs of said master electrical plug from said wall outlet;

first locking means for selectively securing said selectively removable security cover means to said base means to prevent tampering and the like;

electrical switching means operatively disposed in an electrical circuit between said master electrical plug and said at least one electrical plug receptacle for selectively opening and closing said electrical circuit; and second locking means operatively coupled to said power transfer means for selectively closing said switching means to complete an electrical path between said master electrical plug and said at least one electrical plug receptacle and for selectively opening said switching means for breaking the circuit between said master electrical plug and said at least one electrical plug receptacle so as to selectively electrically energize and deenergize said at least one electrical plug receptacle from said master electrical plug to prevent the transfer of electrical power therebetween.

2. The plug lock apparatus of claim 1 wherein said fastening means includes a setting screw means for operatively coupling said housing enclosure means to said electrical wall outlet to assure that said master electrical plug continually mechancially and electrically engages said electrical outlet, and wherein said selectively removable security cover means includes means for restricting access to said setting screw means and to said at least one electrical plug receptacle; and first key-operated locking means for locking said selectively removable security cover means on said base means of said housing enclosure means to prevent unauthorized removal thereof thereby preventing access to said setting screw and the removal of said housing enclosure means from said wall outlet.

3. The plug lock of claim 2 wherein said second locking means includes a second key-operated locking means electrically coupled to said power transfer means for selectively actuating and de-actuating said electrical switching means.

4. The plug lock of claim 3 wherein said housing enclosure means is generally rectangular in shape having open rear and bottom sides and wherein said selectively removable security cover means is adapted to be slidably received within said base means so that said selectively removable security cover means can be selectively slidably inserted and removed therefrom for preventing unauthorized access to said fastening means and said at least one plug receptacle and the corresponding appliance plug inserted therein.

5. The plug lock of claim 4 wherein said selectively removable security cover means includes a generally L-shaped integral panel means for adding rear and bottom sides to said base means to complete the construction of said generally rectangular housing enclosure means when said selectively removable security cover means is operatively secured to the base means of said housing enclosure means.

6. The plug lock of claim 5 wherein said selectively removable security cover means includes at least one slot therein through which an electrical cord operatively coupled to said appliance plug may pass but through which said electrical appliance plug cannot be removed from said housing enclosure means once said selectively removable security cover means is slidably inserted into said base means and locked therein.

7. The plug lock of claim 6 wherein said selectively removable security cover means includes an enlongated latching slot, wherein said first locking means includes an elongated latching arm and means for pivotably securing one end of said latching arm adjacent the bottom of said base means, the length of said latching arm being such that it extends through said latching slot when said selectively removable security cover means is slidably positioned on said base means and a key-operated means for selectively rotating said latching arm in a first direction to disposed said latching arm substantially perpendicular to the plane of said cover means for extending said latching arm out of said elongated latching slot to prevent removal of said selectively removable security cover means from the base means and for selectively rotating said latching arm in a second direction to withdraw said latching arm from said elongated latching slot for enabling said selectively removable security cover means to be slidably removed from said base means.

8. A pilfer-proof electrical plug-locking apparatus for securing an electrical plug from an external utilization device and a receptacle proximate a wall outlet comprising:

a generally rectangular housing means including a base means and removable security cover means adapted to be operatively received by said base means for forming a relatively completely enclosed generally rectangular box-like housing means;

a wall outlet-engaging plug operatively mounted proximate the back surface of said base means and including plug prongs, said plug prongs being permanently extended through the back surface of said base means;

fastening means operatively disposed within said housing means and exteriorly through a bottom surface of said base means for relatively fixedly securing said housing means proximate said wall outlet, said base means being oriented with respect to said wall outlet such that said permanently extended plug prongs become relatively permanently mechanically and electrically engaged with said wall outlet as said base means is mounted proximate said wall outlet by said fastening means for insuring a continuous supply of electrical power from said wall outlet to said wall outlet-engaging plug;

at least one external utilization device electrical plug receptacle operatively secured within said base means for mechanically and electrically receivably engaging the prongs of at least a corresponding one of said external utilization device plugs, said at least one of said external utilization device plugs being operatively connected to the external utilization device through an electrical cord means;

said removable security cover means including means for operatively receiving at least one of said electrical power cord means therein when said removable security cover means is removed from said base means and for preventing said at least one of said external utilization device plugs from being physically removed from said housing means once said removable security cover means is secured to said base means and for prohibiting access to said fastening means to prevent said housing means from being removed from said wall outlet before said removable security cover means is secured to said base means;

electrical circuit means operatively coupled between said at least one external utilization device electrical plug receptacle and said wall outlet-engaging plug for completing an electrically conductive path between said wall outlet and said external utilization device via said wall outlet-engaging plug, said electrical circuit means, said at least one external utilization device electrical plug receptacle, said at least one of said external utilization device plugs and said at least one of said electrical power cord means;

key-operated security cover locking means for selectively locking said removable security cover means to said base means for preventing the removal of said removable security cover means from said base means and for prohibiting access to said fastening means within the interior of said housing means and for selectively unlocking said removable security cover means from said base means for enabling the removal of said removable security cover means therefrom for granting access to the interior of said housing means, said key-operated security cover locking means including a lock tumbler means operatively disposed within said base means, a latching means responsive to said locking tumbler means for performing the locking and unlocking function, and an externally disposed key inlet means operatively extended through a side portion of said housing means, for allowing an authorized users key to be inserted into said externally disposed key inlet for turning in a first direction to rotate said lock tumbler means in a first direction for locking the removable security cover means to the base means and for turning in the opposite direction for operating said latching means to unlock said removable security cover means from said base means;

key-operated power control locking means including a power control latching tumbler means operatively disposed within said housing, a power control linkage mechanism means responsive to said power control latching tumbler means for selectively controlling an electrical switch operating means, and a key insert means operably extended externally through one side of the housing means for providing a key insertion means on the outside thereof, said key insert means of said housing means for receiving an authorized users key therein for manually rotating said power control latching tumbler means in a first direction for positioning said power control linkage mechanism means in a first switch control position and for manual rotation in the opposite direction for positioning said power control linkage mechanism means to a second switch control position; and said electrical circuit means including an electrical switching means responsive to said first switch control position of said power control linkage mechanism means for completing a circuit between said wall outlet-engaging plug and said at least one external utilization device electrical plug reeceptcle for supplying power from the wall outlet to the external utilization device and responsive to said second switch control position of said power control linkage mechanism means for breaking the circuit between the wall outlet-engaging plug and said power control latching tumbler means for stopping the flow of electrical power from said wall outlet to said external utilization device.

9. The pilfer-proof electrical plug-locking apparatus of claim 8 wherein said base means includes a back panel, three side panels, an open end, and an open front, each of the three sides including a flange portion operably disposed approximately perpendicular to the plane of each side and disposed inwardly over and parallel to the back panel for defining a sliding guide path;

wherein said removable security cover means includes a front panel cover and an integrally formed plurality of slot-defining L-shaped leg portions, said slots being adapted to operably receive said electrical power cord therein when said removable security cover means is removed from said base means, said front panel cover being adapted to slidably engage said sliding guide portion of said base means for sliding said removable cover means therein so that said front panel cover means covers substantially the complete open front side of said base means and that portion of said L-shaped leg portions which is integral with and approximately perpendicular to the lower distal end portion of the front cover of the panel is adapted to close said open end of the housing means while the opposite end of the L-shaped leg portions which is substantially parallel to the plane of the front cover panel is adapted to slide into the base means along the back panel thereof for preventing the legs from being bent out to gain unauthorized access to the housing means; and wherein said front cover plate of said removable security cover means further including an enlongated slot means for operatively engaging cover locking latching means for locking said removable security cover means in position slidably within said base means when said cover locking latching means extends through said enlongated slot and for releasing said removable security cover means for slidable removal from said base means whenever said latching means is removed from said enlongated slot.

* * * * *